US008118197B2

(12) United States Patent
Duffield

(10) Patent No.: US 8,118,197 B2
(45) Date of Patent: Feb. 21, 2012

(54) METHOD OF MAKING AEROSOL VALVE MOUNTING CUPS AND RESULTANT CUPS

(75) Inventor: Dean Duffield, Camden (AU)

(73) Assignee: Precision Valve Corporation, Yonkers, NY (US)

( * ) Notice: Subject to any disclaimer, the term of this patent is extended or adjusted under 35 U.S.C. 154(b) by 1230 days.

(21) Appl. No.: 11/820,184

(22) Filed: Jun. 18, 2007

(65) Prior Publication Data

US 2008/0308582 A1 Dec. 18, 2008

(51) Int. Cl.
*B23P 17/02* (2006.01)

(52) U.S. Cl. ..... 222/402.1; 72/348; 72/379.4; 413/8; 413/56

(58) Field of Classification Search ..... 222/402.1; 29/890.122, 557, 558; 72/348, 347, 349, 72/379.4; 413/8, 56
See application file for complete search history.

(56) References Cited

U.S. PATENT DOCUMENTS

| | | | | |
|---|---|---|---|---|
| 1,890,936 | A | 12/1932 | Douglass | |
| 3,796,085 | A | 3/1974 | Fisher et al. | |
| 3,807,332 | A | 4/1974 | Okubo et al. | |
| 3,957,005 | A | 5/1976 | Heffner | |
| 4,005,665 | A | 2/1977 | Nishihara et al. | |
| 4,136,629 | A | 1/1979 | Luthi | |
| 4,244,315 | A | 1/1981 | Klein | |
| 4,290,294 | A | 9/1981 | Diemi | |
| 4,512,172 | A * | 4/1985 | Abbott et al. | 72/68 |
| 4,571,978 | A | 2/1986 | Taube et al. | |
| 4,587,825 | A | 5/1986 | Bulso, Jr. et al. | |
| 4,587,827 | A | 5/1986 | Wessels | |
| 4,603,571 | A | 8/1986 | Wessels | |
| 4,704,887 | A | 11/1987 | Bachmann et al. | |
| 4,711,611 | A | 12/1987 | Bachmann et al. | |
| 4,713,958 | A | 12/1987 | Bulso, Jr. et al. | |
| 4,715,208 | A | 12/1987 | Bulso, Jr. et al. | |
| 4,716,755 | A | 1/1988 | Bulso, Jr. et al. | |
| 4,745,792 | A | 5/1988 | Story et al. | |
| 4,754,635 | A | 7/1988 | van den Berg et al. | |
| 4,795,045 | A | 1/1989 | Radtke | |
| 4,796,454 | A | 1/1989 | Bulso, Jr. et al. | |

(Continued)

FOREIGN PATENT DOCUMENTS

| | | |
|---|---|---|
| CH | 641 698 | 3/1984 |

(Continued)

OTHER PUBLICATIONS

International Search Report for corresponding International Patent Application No. PCT/US2008/087225 dated Feb. 13, 2009.

(Continued)

*Primary Examiner* — J. Casimer Jacyna
(74) *Attorney, Agent, or Firm* — Ohlandt, Greeley, Ruggiero & Perle, LLP

(57) ABSTRACT

Metal discs, preferably circular, are cut to a precise diameter and drawn to a preform with a channel and skirt for an aerosol valve mounting cup. The preform then undergoes further forming operations at stations in a press system. "Bumping" is carried out on the skirt edge at a station, to eliminate non-burr trimming of the cup edge, save material and obtain a carefully controlled skirt height and a substantially even skirt edge with minimized earring. The resultant cup terminating skirt edge is characterized by reformed metal. A further coaxing or pinch-cut operation may be performed on the cup skirt.

14 Claims, 7 Drawing Sheets

U.S. PATENT DOCUMENTS

| | | | |
|---|---|---|---|
| 4,808,052 | A | 2/1989 | Bulso, Jr. et al. |
| 4,833,903 | A | 5/1989 | de Smet |
| 4,862,722 | A | 9/1989 | Fraze et al. |
| 4,903,521 | A | 2/1990 | Bulso, Jr. et al. |
| 4,934,168 | A | 6/1990 | Osmanski et al. |
| 4,977,772 | A | 12/1990 | Bulso, Jr. et al. |
| 5,014,537 | A | 5/1991 | Nine |
| 5,016,785 | A | 5/1991 | Greenebaum, II |
| 5,024,077 | A | 6/1991 | Bulso, Jr. et al. |
| 5,042,284 | A | 8/1991 | Stodd et al. |
| 5,062,287 | A | 11/1991 | Brown et al. |
| 5,068,964 | A | 12/1991 | Yabuno et al. |
| 5,157,969 | A | 10/1992 | Roper |
| 5,179,854 | A | 1/1993 | Matsui et al. |
| 5,187,966 | A | 2/1993 | Seconde et al. |
| 5,209,099 | A | 5/1993 | Saunders |
| 5,209,341 | A | 5/1993 | Rudolf |
| 5,284,045 | A | 2/1994 | Herdzina |
| 5,287,718 | A | 2/1994 | Yamanashi |
| 5,309,749 | A | 5/1994 | Stodd |
| 5,322,206 | A | 6/1994 | Harada et al. |
| 5,329,799 | A | 7/1994 | Ito et al. |
| 5,331,836 | A | 7/1994 | Cudzik |
| 5,356,256 | A | 10/1994 | Turner et al. |
| 5,363,685 | A | 11/1994 | Luthi et al. |
| 5,381,683 | A | 1/1995 | Cowling |
| 5,400,652 | A | 3/1995 | Haar |
| 5,442,947 | A | 8/1995 | Stodd |
| 5,445,305 | A | 8/1995 | Johr et al. |
| 5,502,995 | A | 4/1996 | Stodd |
| 5,577,427 | A | 11/1996 | Haar |
| 5,600,991 | A | 2/1997 | Munzen |
| 5,607,281 | A | 3/1997 | Egolf et al. |
| 5,623,847 | A | 4/1997 | Uchiyama et al. |
| 5,630,337 | A | 5/1997 | Werth |
| 5,634,366 | A | 6/1997 | Stodd |
| 5,711,176 | A | 1/1998 | Komatsu |
| 5,718,143 | A | 2/1998 | Clowes |
| 5,722,282 | A | 3/1998 | Mine et al. |
| 5,727,916 | A | 3/1998 | Krebs et al. |
| 5,823,040 | A | 10/1998 | Stodd |
| 5,901,598 | A | 5/1999 | Haar |
| 5,901,599 | A | 5/1999 | Sato et al. |
| 5,924,188 | A | 7/1999 | Tokunou et al. |
| 5,953,951 | A | 9/1999 | Fujimoto et al. |
| 6,003,359 | A | 12/1999 | Futamura et al. |
| 6,010,040 | A | 1/2000 | Duffield et al. |
| 6,032,504 | A | 3/2000 | Onat et al. |
| 6,032,505 | A | 3/2000 | Stodd |
| 6,038,910 | A | 3/2000 | McClung |
| 6,047,583 | A | 4/2000 | Schroth |
| 6,079,249 | A | 6/2000 | Turner et al. |
| 6,082,166 | A | 7/2000 | Marin |
| 6,089,072 | A | 7/2000 | Fields |
| 6,122,814 | A | 9/2000 | Pennig et al. |
| 6,167,742 | B1 | 1/2001 | Marin |
| 6,290,447 | B1 | 9/2001 | Siemonsen et al. |
| 6,336,780 | B1 | 1/2002 | Chasteen |
| 6,351,980 | B1 | 3/2002 | Jowitt et al. |
| 6,351,981 | B1 | 3/2002 | Jowitt et al. |
| 6,374,657 | B1 | 4/2002 | Kirk et al. |
| 6,481,256 | B1 | 11/2002 | Beyer et al. |
| 6,490,904 | B1 | 12/2002 | Zauhar |
| 6,505,492 | B2 | 1/2003 | Jroski |
| 6,539,767 | B2 | 4/2003 | McClung |
| 6,588,244 | B2 | 7/2003 | Chevalier |
| 6,658,911 | B2 | 12/2003 | McClung |
| 6,773,217 | B2 | 8/2004 | Sinsel et al. |
| 6,802,197 | B2 | 10/2004 | Barrera |
| 6,830,419 | B1 | 12/2004 | Turner et al. |
| 6,915,244 | B2 | 7/2005 | Yamano et al. |
| 6,923,342 | B2 | 8/2005 | Bourque et al. |
| 6,932,244 | B2 | 8/2005 | Meshberg |
| 7,066,702 | B2 | 6/2006 | Turner et al. |
| 2001/0013239 | A1 | 8/2001 | Yamano et al. |
| 2001/0037668 | A1 | 11/2001 | Fields |
| 2002/0170334 | A1 | 11/2002 | Zauhar |
| 2004/0250594 | A1 | 12/2004 | Schwenk |
| 2005/0044920 | A1 | 3/2005 | McClung |
| 2005/0076695 | A1 | 4/2005 | Turner et al. |
| 2005/0139050 | A1 | 6/2005 | Haar |

FOREIGN PATENT DOCUMENTS

| | | | |
|---|---|---|---|
| CH | 681 433 | | 3/1993 |
| DE | 24 20 599 | | 10/1975 |
| DE | 26 40 379 | | 5/1978 |
| DE | 27 06 054 | | 8/1978 |
| DE | 83 18 201 | U1 | 9/1983 |
| DE | 83 18 202 | U1 | 9/1983 |
| DE | 33 27 590 | A1 | 2/1985 |
| DE | 87 16 413 | U1 | 3/1988 |
| DE | 87 14 829 | U1 | 6/1988 |
| DE | 3841 683 | A1 | 11/1989 |
| DE | 43 22 185 | A1 | 1/1995 |
| DE | 298 04 297 | U1 | 7/1999 |
| DE | 201 09 137 | U1 | 10/2002 |
| EP | 0 278 062 | A2 | 8/1988 |
| EP | 0 518 613 | A1 | 12/1992 |
| EP | 0 616 861 | A1 | 9/1994 |
| GB | 2 235 641 | A | 3/1991 |
| WO | WO 84/03647 | | 9/1984 |
| WO | WO 86/06306 | | 11/1986 |
| WO | WO 02/40193 | A2 | 5/2002 |
| WO | WO0240193 | A2 | 5/2002 |
| WO | WO 03/061867 | A1 | 7/2003 |

OTHER PUBLICATIONS

"Aerosols—Science & Technology" International Publishers, Inc. © 1961 (Figs 11-13 on pp. 132-133).

Supplementary European Search Report corresponding to European Patent Application No. 08874661.5 dated Oct. 27, 2011.

* cited by examiner

METHOD OF MAKING AEROSOL VALVE MOUNTING CUPS AND RESULTANT CUPS

FIELD OF THE INVENTION

The present invention relates to aerosol valve mounting cups, into which are mounted aerosol valves and which cups are in turn mounted onto the tops of aerosol product containers. More particularly this invention relates a new method of manufacturing said mounting cups, and the resultant cups.

BACKGROUND OF THE INVENTION

The well known and long existing aerosol valve mounting cup is generally a metal member having an outer circular channel which is placed over the circular bead of the aerosol can defining the opening into the aerosol can. The outer side of the channel terminating in a circular edge is commonly known as the skirt of the mounting cup and is crimped onto the can bead with a sealing medium (sleeve gasket, laminated gasket, cut gasket, coated gasket, etc.) positioned in between the channel and can bead.

The interior area of the mounting cup extends down into the can opening and has an upstanding pedestal portion into which is mounted and captured the aerosol valve itself. The dispensing valve stem in the case of a male valve extends upwardly through a central opening in the pedestal. A female valve uses the same basic mounting cup design.

Prior art mounting cups have traditionally been manufactured by forming metal blanks and performing a number of pressing/drawing operations on the metal blanks to arrive at the mounting cup shape. The skirt height of the mounting cup channel is viewed to be critical in relation to the can bead dimensions and also because of hopper feed bowls and other assembly equipment controlled by skirt height. In order to obtain the specified skirt height, mounting cups have been manufactured initially leaving excess metal material at the outer edge. The mounting cup is then passed through a late stage trimming station which cuts material from the extended outer edge to obtain the specified and critical skirt height in the finished mounting cup. Even under such circumstances, the outer edge/lip of the skirt will have an undesirable lack of evenness known as earring.

Given the hundreds of millions of mounting cups produced each year, it can easily be appreciated that there is a large excess material cost involved in the metal trimmed from the outer edge of each mounting cup. There is also the additional cost involved in requiring a trimming station in each production line.

Accordingly, it would be highly desirable to eliminate the need to trim the mounting cup edges and, thus, the need for the trimming station. It would also be desirable to minimize the presence of earring, or skirt height variation, in the final cup.

SUMMARY OF THE INVENTION

The present invention produces mounting cups that do not require the aforesaid final trimming operation, and yet obtains a carefully controlled skirt height and a substantially even outer edge with minimized earring.

In the method of the present invention, preferably circular discs are initially cut from a sheet of steel, tinplate or aluminum, including laminated or coated versions thereof. Non-circular blanks can be used in the present invention, but are less desirable because of reasons including the need for more complicated pressing/drawing equipment that requires die alignments and equipment maintenance beyond that where circular blanks are used, and because of potentially excess material cost from the non-circular blank shape.

The circular discs are cut to a precise diameter that, along with other aspects of the present invention relating to a "bumping" operation, results in the final mounting cup with no trimming operation and with a carefully controlled specified skirt height and substantially even skirt edge. The circular disc is then drawn to a preform for the mounting cup in a first preform press. The cutting of the disc may be carried out by a cutting die at the first preform press. The preform is essentially in a "high hat" configuration with a channel and skirt formed but with no pedestal yet formed, for example. The channel in the preform (and in the final mounting cup) may be rounded, flat or multi-radiused, for example. The edge of the skirt will have a wave or earring, the extent of which will depend upon the grade, temper and structure of the cup material being used and the processing to obtain the channel and skirt in the preform.

The preform is then moved to further press/draw stations in a separate press for further forming operations, for example, the conventional and well-known reverse, reduction and sizing operations among others. These operations may be carried out at sequential stations in a belt fed or feed bar transfer press as disclosed herein but other forms of press systems could likewise carry out the method of the present invention. The essential "bumping" operation of the present invention may be advantageously carried out at the sizing station, but also could be carried out at other forming stations in the press or at a separate dedicated "bumping" station. Following the sizing station may be a further "coaxing" or pinch-cut station for further processing of the mounting cup skirt as more fully disclosed in U.S. Pat. No. 6,010,040 of Jan. 4, 2000 titled "Improved Mounting Cup For An Aerosol Container", incorporated herein by reference.

The essential "bumping operation" of the present invention allows a circular disc to be initially used for the preform and eliminates the need for any non-burr trimming operation of the skirt edge after formation of the mounting cup. As described herein, the "bumping operation" is carried out in the transfer press sizing station.

After the preform has passed through reverse and reduction press stations, for example, the partially formed mounting cup with its pedestal portion now added is belt fed to the sizing station. The reverse and reduction stations do not affect the skirt height of the preform. At the sizing station, the sizing die, sizing pad and sizing punch establish the dimensions and configuration of the mounting cup radially inward of the channel skirt. As this sizing is occurring, a centering ring with a cut-out near its outer periphery, or a separate (or integral) bumping ring, acts to bump (meaning here to strike, hit upon) the edge/lip of the mounting cup skirt to reduce/control the height of the skirt to its specified dimension, and at the same time to even out the skirt edge/lip to minimize or eliminate earring. The resulting bumped edge may be characterized by reformed metal, the edge having a shiny area and/or a slightly thicker cross-section resulting from the bumping. Other configurations of tooling may be used for the bumping, as long as they operate to set the correct skirt height and eliminate or minimize earring. No trimming is thereafter needed or used to obtain the proper skirt height and substantial material and cost savings are thereby realized.

In the "coaxing"/pinch cut station following the sizing/bumping station, the skirt near the skirt edge is angled inwardly and further has a coined or embossed inward angle placed on the outside edge of the skirt. A burr-free outside skirt edge is obtained by the coining/embossing to avoid scratching other cups in post-manufacture operations, and the inwardly angled skirt results in less contact area with the skirts of adjacent mounting cups in handling, shipping, valve assembly, gasketing, etc. following formation of the mounting cups. In addition, the inwardly angled skirt can facilitate retention of cut gaskets when used as the sealant in the mounting cup channel.

Other features and advantages of the present invention will be apparent from the following description, drawings and claims.

DETAILED DESCRIPTION OF EMBODIMENTS

Figure 1:
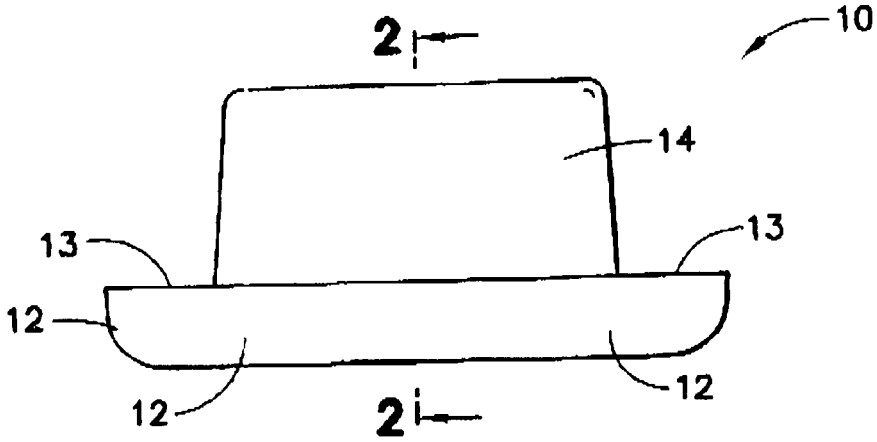
FIG. 1 is a side elevation of a conventional manufactured aerosol valve mounting cup, shown in conventional upside-down position when standing alone.
Figure 2:
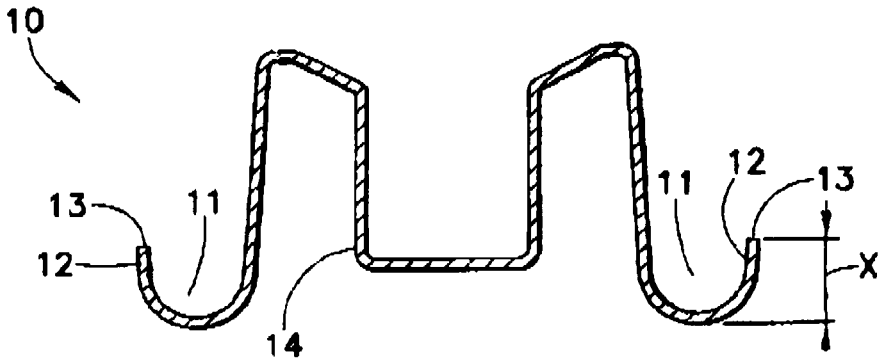
FIG. 2 is a diametrical cross-sectional view taken along lines 2-2 of FIG. 1.
Figure 3:
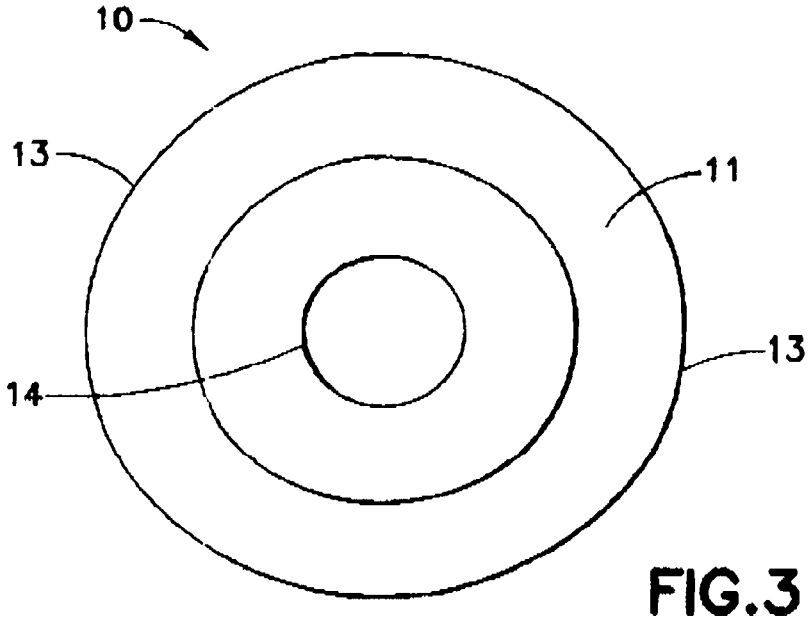
FIG. 3 is an overhead plan view of the mounting cup of FIG. 1.

Referring to FIGS. 1, 2 and 3, a conventional aerosol mounting cup 10 is shown having a circular channel 11, a skirt 12 having a skirt height x, a skirt edge/lip 13, and a pedestal portion 14. The channel 11 is mounted over the well-known aerosol can bead (not shown) defining the can top opening, and the well-known aerosol valve (not shown) is mounted through the pedestal 14 of the aerosol mounting cup. All of this structure and assembly is well known in the aerosol art and needs no further description here.

Figure 5A:
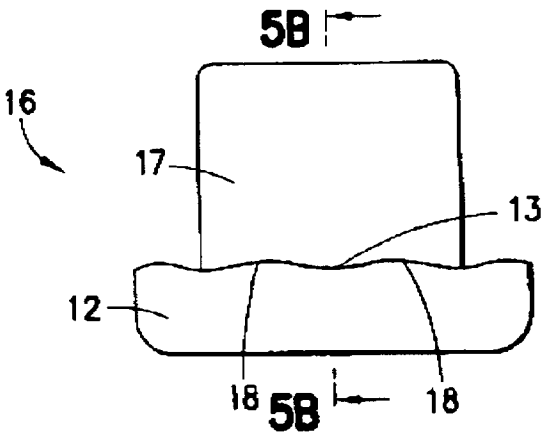
FIG. 5A is a side elevation of the mounting cup preform of the present invention in the upside-down position, also illustrating an uneven skirt edge with earring.
Figure 5B:
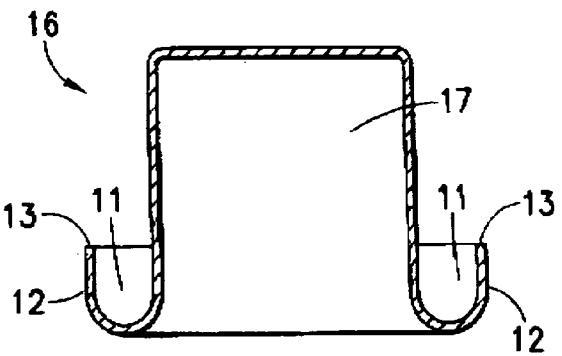
FIG. 5B is a diametrical cross-sectional view of the mounting cup preform taken along lines 5B-5B of FIG. 5A.
Figure 4A:
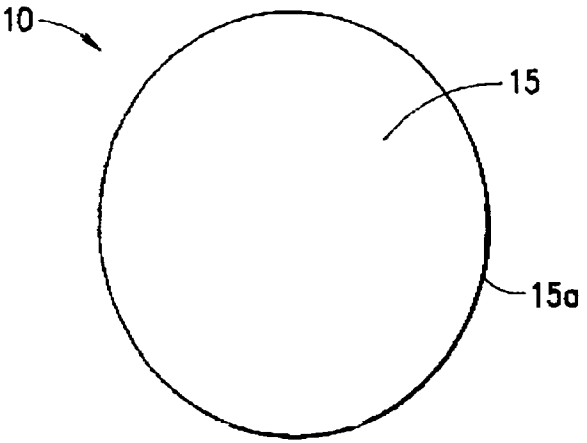
FIG. 4A is an overhead view of a cut circular disc used to form the mounting cup of the present invention.
Figure 4B:
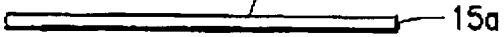
FIG. 4B is a side elevation of the cut circular disc of FIG. 4A.

The aerosol mounting cup of the present invention is made beginning with preferably circular metal disc 15 cut from a metal sheet and having cut edge 15*a*, as shown in FIGS. 4A and 4B. Circular metal disc will have a predetermined cut diameter, for example, 48.1 mm, that allows the benefits of the present invention to be obtained and without a conventional trimming operation. Metal disc 15 is then formed into a cupped preform 16 by a standard drawing operation in a preform press 20 (see FIG. 6) whereby the preform 16 takes the shape shown in FIGS. 5A and 5B with circular channel 11, skirt 12, skirt edge/lip 13, and "high hat" 17. Skirt edge/lip 13 in the preform will have an unevenness and earring about its perimeter shown in exaggerated fashion at 18 in FIG. 5A.

Figure 7:
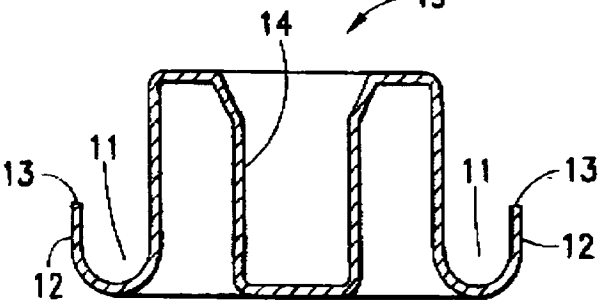
FIG. 7 is a diametrical cross-sectional view of a partially formed mounting cup after the preform has passed through the reverse and reduction draw stations of the transfer press before undergoing the sizing operation.
Figure 6:
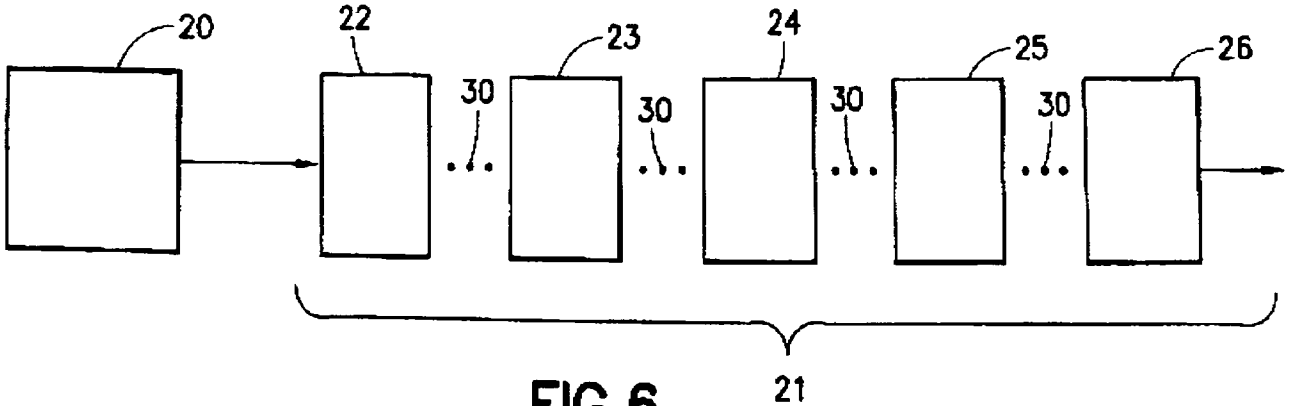
FIG. 6 is a schematic illustration of the first press used to form the preform, and the belt fed transfer second press with its various stations used to sequentially form the completed mounting cup from the preform.

Preform 16, as made in preform press 20 shown schematically in FIG. 6, is then moved to belt fed transfer press 21 schematically shown in FIG. 6 and having a plurality of forming stations. Station 22 may be a reverse drawing station and station 23 may be a reduction drawing station. Upon leaving reduction drawing station 23, the preform has become a partially formed mounting cup 19 as shown in FIG. 7 having a pedestal portion 14. It is in this configuration that the partially formed mounting cup arrives at sizing station 24 of transfer press 21. Moving index belt 30 on a stationary support surface transfers the mounting cup being formed from station to station in the transfer press. Reverse and reduction stations used in the formation of mounting cups are well known in the art, and no further description is believed necessary. Sizing stations also are generally well known in the art.

Figure 8A:
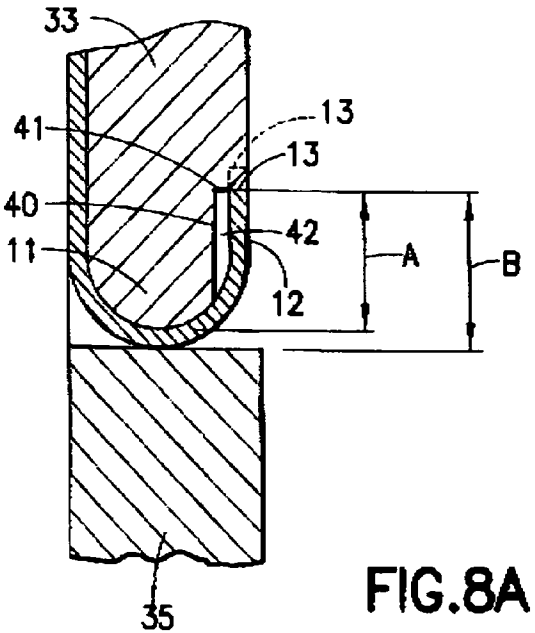
FIG. 8A is an enlarged fragmentary portion from FIG. 8 illustrating sizing of the cup channel and bumping of the skirt edge of the channel.
Figure 8:
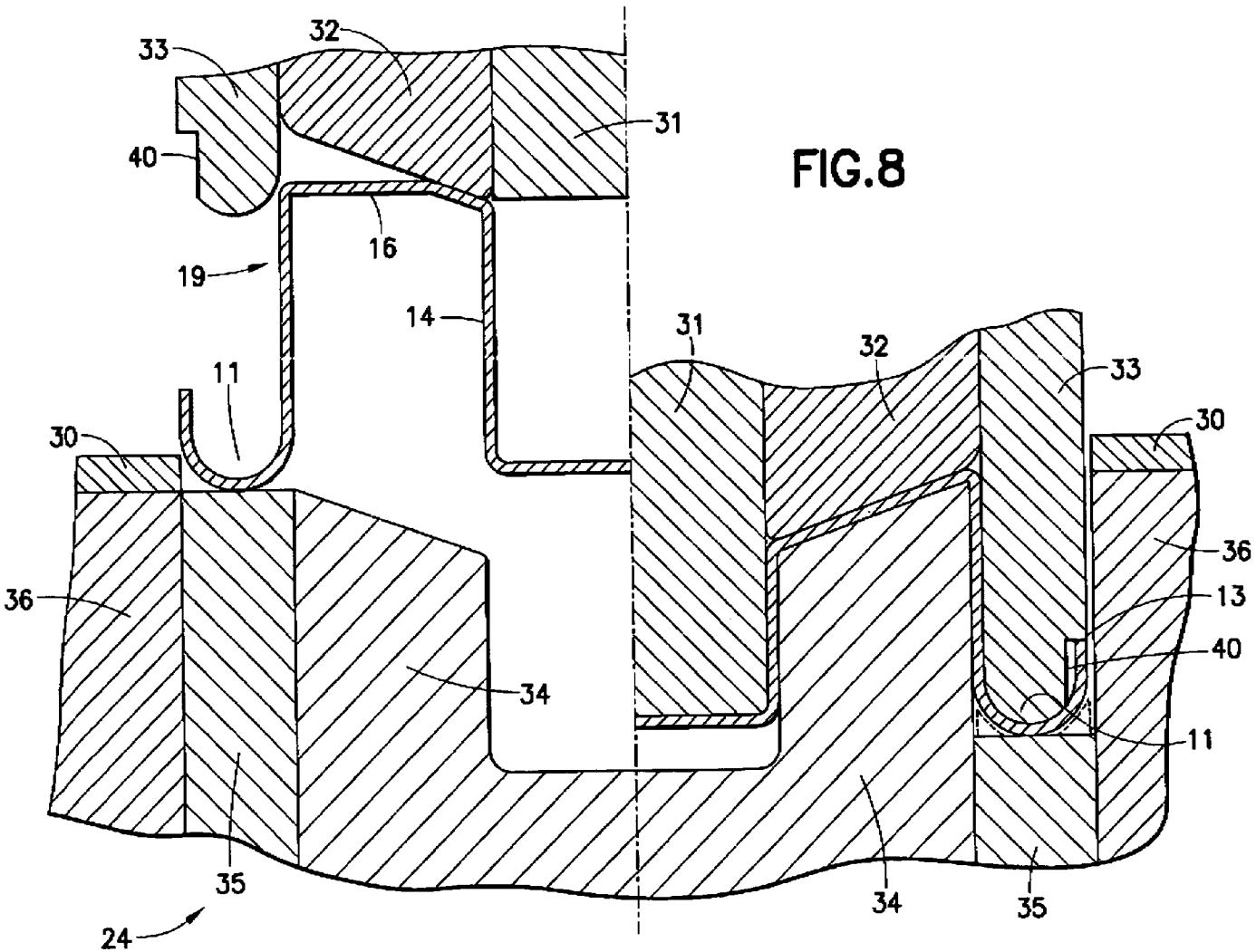
FIG. 8 is a diametrical cross-sectional view of the sizing/bumping station, showing on the left side the tooling in open position with the delivered partially formed mounting cup of FIG. 7 in position, and showing on the right side the tooling in closed position with the mounting cup being sized and the cup skirt edge being bumped.

Referring now to FIG. 8, the sizing/bumping station 24 of FIG. 6 is shown in detail. Partially formed mounting cup 19 of FIG. 7 has been fed into the open tooling of station 24 (left side of FIG. 8) by belt 30 moving on stationary substrate plate 36. Belt 30 indexes in a direction perpendicular to the plane of FIG. 8. The circular tooling of FIG. 8 includes sizing punch 31, sizing die 34, sizing pad 32, support ring 35 and centering ring/sizing bushing 33. The tooling then moves to the closed position shown on the right side of FIG. 8 to carry out the sizing operations, and the partially formed mounting cup 19 is reformed/sized to the desired configuration and dimensions as shown on the right side of FIG. 8.

The essential bumping operation of the present invention is carried out on the skirt edge 13 in the sizing station 24 during the sizing operation as the tooling is closed. More specifically, centering ring/sizing bushing 33 is shown in FIGS. 8 and 8A having a cut out notch 40 in its outer diameter near its base, notch 40 extending about the circumference of centering ring/sizing bushing 33 (see the left side of FIG. 8 also showing notch 40).

When the sizing operation on the mounting cup is carried out as shown on the right side of FIG. 8, centering ring/sizing bushing 33 bottoms in mounting cup channel 11. Just before that occurs, the top surface 41 of notch 40 bumps (strikes) against skirt edge 13 to shorten the skirt to skirt height B (see FIG. 8A) specified for the cup, which may be 3.4±0.15 mm, for example. As the bumping occurs, excess metal from skirt edge 13 can flow back into the mounting cup or into space 42 shown in FIG. 8A between the inside surface of skirt 12 and the vertical side wall of notch 40. The skirt height may often slightly exceed maximum skirt height B before the sizing operation of FIG. 8 in station 24. The dotted lead line 13 of FIG. 8A shows in exaggerated fashion the level of skirt edge 13 before the bumping operation occurs. As previously discussed, the skirt edge 13 before the bumping can also have an uneven edge or earring, and the bumping operation will also serve to even out the earring of skirt edge 13. The bumping operation of the present invention, therefore, provides the desired tight control of the mounting cup skirt height and the elimination or minimization of earring at the skirt edge, further characterized by the elimination of the costly trimming operation in general use to establish skirt height.

Further referring to FIG. 8A, centering ring/sizing bushing 33 captures the mounting cup between ring 33 and support ring 35 and may lightly clamp the mounting cup as the bumping of the skirt edge 13 occurs. If desired, the top of support ring 35 may be radiused as shown in dotted lines in FIG. 8 to back up and support more of the channel portion of the mounting cup during the sizing and the bumping. Dimension A is shown in FIG. 8A as the distance between the bottom of ring 33 and surface 41 of notch 40. This distance is established in the tooling to control the desired degree of bumping to meet the skirt height specification.

Figure 9:
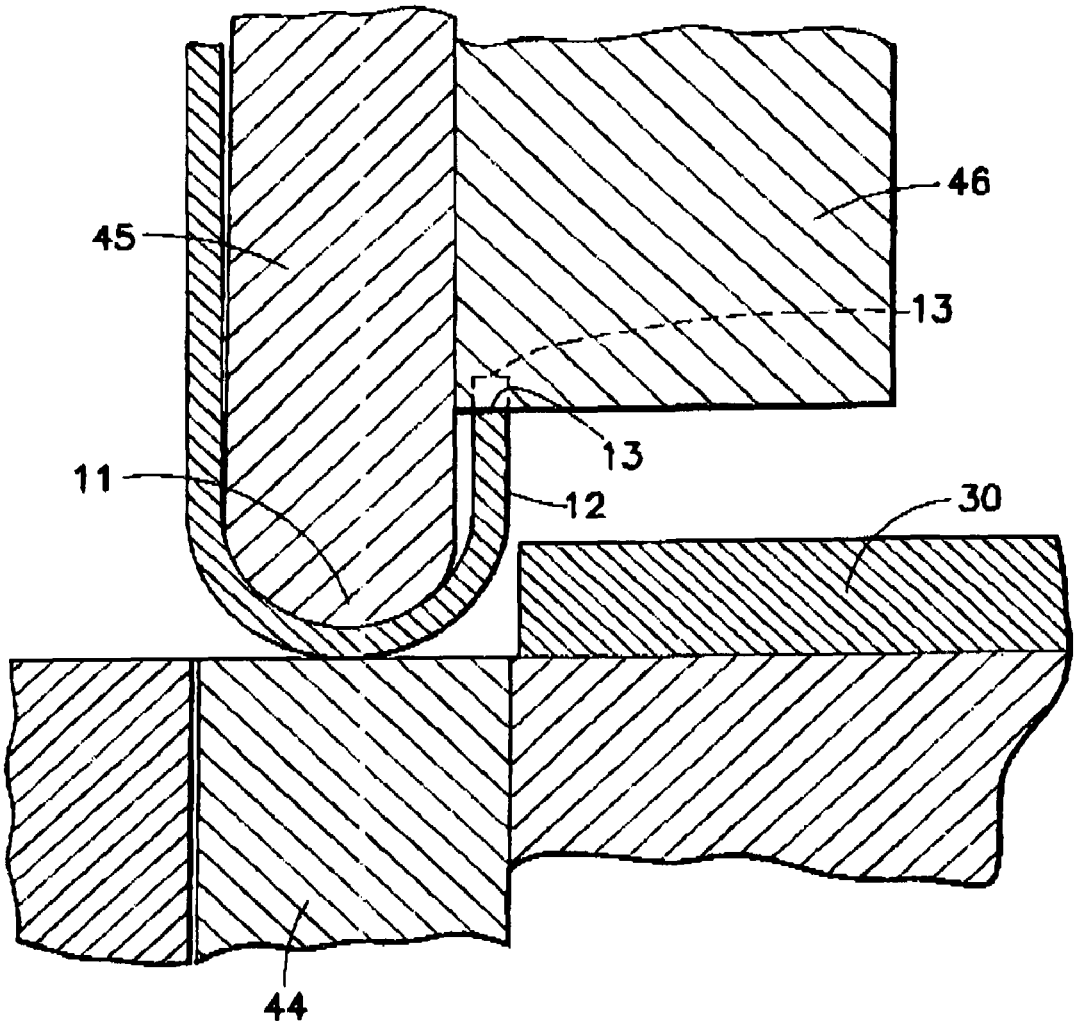
FIG. 9 is a fragmentary diametrical cross-sectional view of an alternative bumping operation and arrangement of tooling in a transfer press station following the sizing station.

It should be appreciated that various alternative tooling set ups may be used to obtain the bumping operation of the present invention. FIG. 9 illustrates one such alternative where a separate dedicated transfer press station for bumping follows the station operating the sizing die. In FIG. 9, for example, the mounting cup channel 11 may be clamped between lower support plate 44 and centering ring 45 prior to bumping. Here there is no bumping notch in the side wall of centering ring 45. Rather, a separate bump ring 46 is thereafter lowered to carry out the bumping operation in the same manner as described for the notch top wall in FIG. 8A. Alternatively, in FIG. 9, the separate bump ring 46 can carry out the bumping operation just before the centering ring 45 bottoms in the channel 11.

The present invention also includes a metal mounting cup for an aerosol valve, wherein the cup includes the inner pedestal portion, the outer circular channel portion, and the skirt portion forming the outer wall of the channel portion, the skirt portion having a specified skirt height and a terminating edge, the terminating edge having a minimized unevenness or earring, and the terminating edge being a bumped edge characterized by reformed metal at the terminating edge. The reformed metal will evidence a shiny area at the edge due to the bumping striking the edge high points; and/or a slightly thicker cross-section at the edge where the bumping has occurred.

Figure 10:
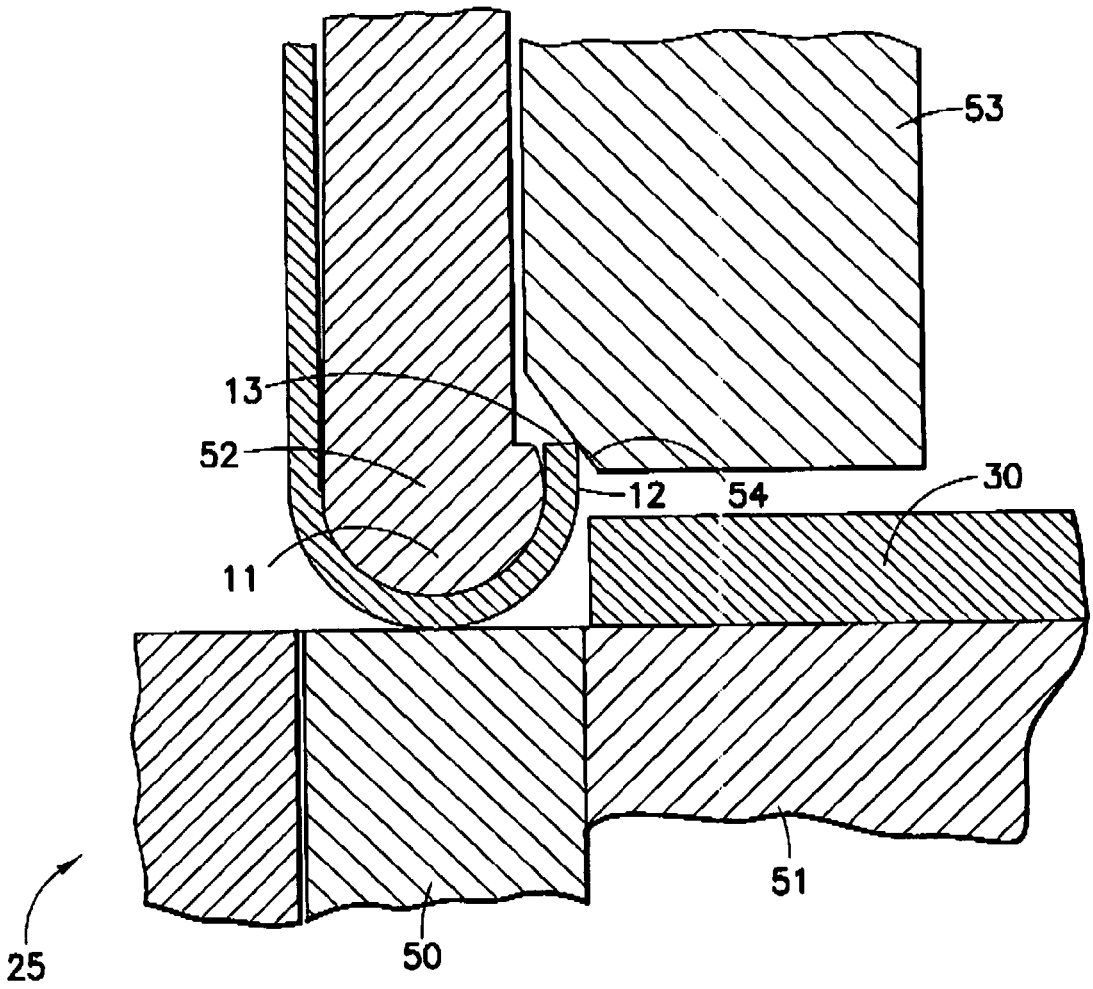
FIG. 10 is a fragmentary diametrical cross-sectional view of a coax/pinch cut station in the transfer press following the sizing/bumping station and illustrating the coaxing operation about to begin upon the mounting cup skirt.
Figure 11A:
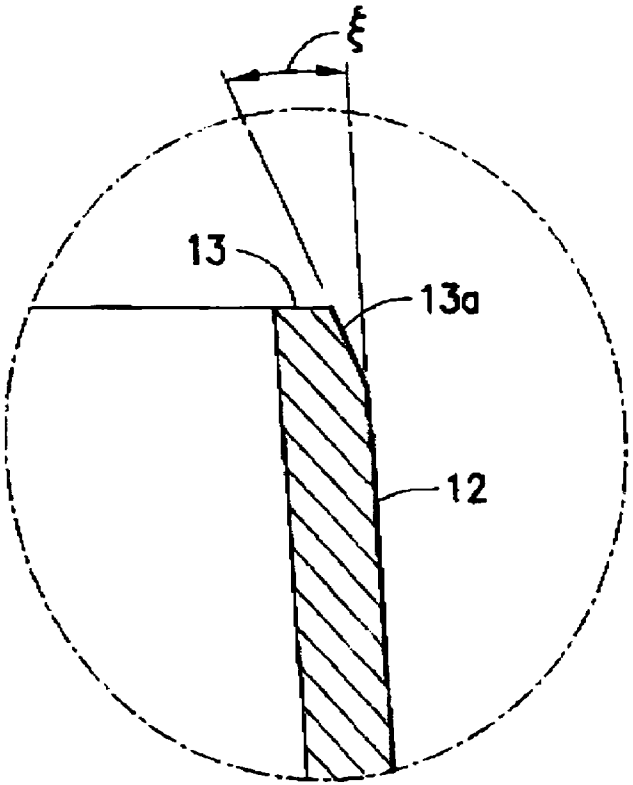
FIGS. 11 and 11A are an illustration showing in enlarged detail the results of the coaxing/pinch cut operation upon the cup skirt.
Figure 11:
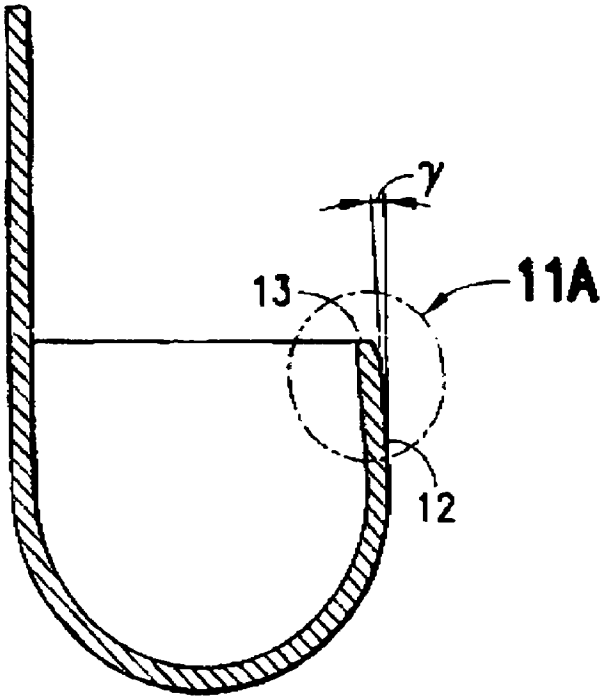

Following the sizing/bumping station(s) in the transfer press 21 is coax station 25 (see FIG. 6) which performs the pinch cut operation. FIG. 10 shows in detail the pinch cut/coaxing station 25, having lower support plate 50 (which may be either flat on its top surface as shown or have a matching radii contour to match the overlying cup profile), die block 51, centering ring 52 and coaxing ring 53. As centering ring 52 captures the channel portion of the mounting cup against lower support plate 50, a bevel 54 on coaxing ring 53 is about to move lower and thus move the outside diameter of skirt 12 near its edge 13 inwardly at an angle y as shown in FIG. 11. This angle y may be of the order of up to three degrees, for example. FIG. 11A shows the further coined or embossed angle z put on the outside edge 13*a* of the mounting cup skirt 13 by bevel 54 of FIG. 10, which further angle z may be of the order of twenty degrees and eliminates outside edge burrs.

While the method of the present invention has been described for a single mounting cup, it will be appreciated that many mounting cups are being made at the same time at high speed. Preform press 20 and transfer press 21 include many side-by-side duplicate stations to make the many cups in parallel feed/indexing operations.

It will be appreciated by persons skilled in the art of making aerosol mounting cups that variations and/or modifications may be made to the method of the present invention without departing from the spirit and scope of the invention. The above embodiments are, therefore, to be considered as illustrative and not restrictive.

What is claimed is:

1. A method of manufacturing a mounting cup for an aerosol valve, said cup having an inner pedestal portion for mounting the aerosol valve, an outer circular channel portion for mounting on the bead of an aerosol container, and a skirt portion forming the outer wall of the channel portion with said skirt portion having a specified skirt height and a terminating edge, said method comprising:

cutting a metal blank from a metal sheet, said metal blank having a curved perimeter;

pressing and drawing said metal blank into a mounting cup preform in a preform pressing and drawing station, said mounting cup preform having a channel portion and a skirt portion having a skirt height and a terminating edge;

performing further forming operations on said mounting cup preform at a plurality of further stations to further form the mounting cup; and performing a bumping operation on said terminating edge at one of said plurality of stations, said bumping operation comprising striking said terminating edge to reduce said skirt height to a specified dimension and to minimize any unevenness of said terminating edge.

2. The method of claim 1, wherein said metal blank is a circular disc.

3. The method of claim 1, wherein the method has a lack of any cutting operation to trim excess non-burr material from a perimeter of the mounting cup during its formation from said metal blank.

4. The method of claim 2, wherein the method has a lack of any cutting operation to trim excess non-burr material from a perimeter of the mounting cup during its formation from said circular disc.

5. The method of claim 1 or claim 2, wherein said metal blank is cut from said metal sheet at said preform pressing and drawing station.

6. The method of claim 1 or claim 2, wherein said plurality of further stations include a sizing station, the method further comprising carrying out said bumping operation at said sizing station.

7. The method of claim 1 or claim 2, wherein said plurality of further stations are a part of a belt fed or feed bar transfer press system.

8. The method of claim 1 or claim 2, further including a coaxing station for moving a lower portion of said skirt portion slightly inward.

9. The method of claim 1 or claim 2, further comprising a circular centering ring that extends into the outer circular channel portion of the cup during the bumping operation, said centering ring having a notch in an outside diameter with an upper notch wall, the method further comprising bumping said terminating edge with the upper notch wall just before bottoming said centering ring in the outer circular channel portion of the cup.

10. The method of claim 1 or claim 2, further comprising a circular centering ring that extends into the outer circular channel portion of the cup during the bumping operation and has an adjacent bumping ring, the method further comprising bumping said terminating edge with said adjacent bumping ring just before bottoming the centering ring in the outer circular channel portion of the cup.

11. The method of claim 1 or claim 2, wherein a circular centering ring extends into the outer circular channel portion of the cup during the bumping operation, the method further comprising clamping the outer circular channel portion between the centering ring and a lower support ring, and thereafter bumping said terminating edge with a separate bumping ring.

12. The method of claim 2, wherein the metal disc has a diameter that is specified to permit the forming of the mounting cup with said skirt height of said specified dimension and without excess non-burr metal being present at a cup perimeter requiring a cutting operation to trim.

13. A method of manufacturing a mounting cup for an aerosol valve, comprising:

forming a metal blank having a curved perimeter;

forming said metal blank into a mounting cup preform, said mounting cup preform having a channel portion and a skirt portion having a skirt height and a terminating edge; and striking said skirt portion terminating edge to reduce said skirt height to a specified dimension and to minimize unevenness of said skirt terminating edge.

14. The method of claim 13, wherein the method has a lack of any cutting operation to trim excess non-burr material from a perimeter of the mounting cup during its formation from said metal blank.

* * * * *